United States Patent [19]

Reuland

[11] 4,147,173

[45] Apr. 3, 1979

[54] APPARATUS FOR MONITORING ROD-SHAPED COMMODITIES IN CIGARETTE MAKING MACHINES OR THE LIKE

[75] Inventor: Joachim Reuland, Hamburg, Fed. Rep. of Germany

[73] Assignee: Hauni Werke Koerber & Co. KG., Hamburg, Fed. Rep. of Germany

[21] Appl. No.: 764,681

[22] Filed: Feb. 1, 1977

[30] Foreign Application Priority Data

Oct. 20, 1974 [DE] Fed. Rep. of Germany ... P2471760

Related U.S. Application Data

[62] Division of Ser. No. 623,660, Oct. 20, 1975, Pat. No. 4,025,770.

[51] Int. Cl.[2] ..... A24C 5/28

[52] U.S. Cl. ..... 131/21 B; 131/23 A

[58] Field of Search ..... 131/23 A, 21 R, 21 B, 131/21 C; 250/223 R, 572, 359, 360, 431; 209/111.7; 93/1 C

[56] References Cited

U.S. PATENT DOCUMENTS

| | | | |
|---|---|---|---|
| 3,040,129 | 6/1962 | Bolt | 250/223 R |
| 3,040,179 | 2/1970 | Hunziker et al. | 250/223 R |
| 3,334,240 | 8/1967 | Black | 250/223 R |
| 3,496,366 | 8/1969 | Kane | 250/223 R |
| 3,812,349 | 5/1974 | Gugliotta et al. | 250/572 |

*Primary Examiner*—Robert W. Michell
*Assistant Examiner*—V. Millin
*Attorney, Agent, or Firm*—Peter K. Kontler

[57] ABSTRACT

A cigarette making machine wherein discrete cigarettes travelling from the cutoff to a transfer conveyor slide along the upper side of a light transmitting guide. A photoelectric detector is mounted below and is shielded by the guide from tobacco dust which is swept away by successive cigarettes. The light source of the detector emits a light beam which passes upwardly through the guide, is reflected by successive cigarettes and thereupon passes downwardly through the guide prior to reaching the photosensitive transducer of the detector. Alternatively, the light source or the detector can be mounted above the guide and above the path of the cigarettes so that the light beam can reach the transducer after having passed through the guide only once, provided that the beam is not interrupted by the cigarettes.

10 Claims, 3 Drawing Figures

APPARATUS FOR MONITORING ROD-SHAPED COMMODITIES IN CIGARETTE MAKING MACHINES OR THE LIKE

CROSS-REFERENCE TO RELATED APPLICATION

This is a division of the copending application Ser. No. 623,660 filed Oct. 20, 1975, now U.S. Pat. No. 4,025,770 granted May 24, 1977.

BACKGROUND OF THE INVENTION

The present invention relates to machines for the making of cigarettes, cigars, cigarillos, filter rod sections and analogous rod-shaped smokers' products. More particularly, the invention relates to improvements in the installation and shielding of components of photoelectric monitoring apparatus in such machines.

It is known to employ photoelectric monitoring apparatus in cigarette making or analogous machines. As a rule, such apparatus comprise a light source or sender and a photosensitive transducer or receiver which latter transmits a signal in response to impingement or interruption of impingement of the light beam issuing from the light source. For example, it is customary to install a detector including a light source and a transducer above the path for discrete cigarettes which slide in a stationary channel between the cutoff and the transfer conveyor of a cigarette making machine wherein the cutoff severs a continuous cigarette rod so that the latter yields a file of discrete cigarettes. The light beam issuing from the source is reflected by the cigarettes and impinges on the transducer whereby the latter produces a signal which can be used for a variety of purposes, e.g., to start the next-following machine of a production line including the cigarette making machine in response to detection of the foremost cigarette subsequent to starting of the cigarette making machine, to arrest the machine or the entire production line in response to detected absence of cigarettes, to start or deactivate one or more units in the cigarette making machine in response to detected presence or absence of cigarettes, and/or many others.

As a rule, photoelectric detectors of the above outlined character are adversely affected by tobacco dust and/or other foreign matter, especially if such foreign matter is allowed to settle on the light source. Any reduction of the intensity of the light beam issuing from the source and/or reduction of the effective area of the photosensitive surface of the transducer as a result of deposition of tobacco dust is likely to affect the accuracy of the monitoring action and can result in premature or delayed stoppage of one or more machines with attendant losses in output.

OBJECTS AND SUMMARY OF THE INVENTION

An object of the invention is to provide a machine for the production of rod-shaped smokers' products wherein the sender (light source) and/or receiver (photosensitive transducer) of a photoelectric monitoring apparatus is shielded from tobacco dust and/or other foreign matter in a simple, inexpensive and reliable manner.

Another object of the invention is to provide the machine with a novel multiple-purpose guide for discrete increments (e.g., discrete cigarettes, cigars, cigarillos or filter rod sections) of a rod or for coherent increments of such rod.

A further object of the invention is to provide a cigarette making or analogous machine with a photoelectric monitoring apparatus whose operation is not affected (or is only slightly affected) by tobacco dust and/or other foreign matter, even if the monitoring apparatus is not cleaned for extensive periods of time.

An additional object of the invention is to reduce the proneness of a photoelectric monitoring apparatus to malfunction in areas where such apparatus is expected to be contaminated by dust developing in cigarette making and analogous machines.

The invention is embodied in a machine for making cigarettes or the like wherein successive increments of a rod having a tubular wrapper and fibrous material confined in the wrapper are conveyed lengthwise along an elongated path. The improvement consists in the provision of a light transmitting guide defining a predetermined portion of the path for the increments of the rod and having first and second sides located opposite each other and respectively disposed nearer to and at a greater distance from the increments in the aforementioned portion of the path, and photoelectric monitoring means including a first component which constitutes a light source and a second component which constitutes a photosensitive transducer. The light source directs a beam of light against one side of the guide, and the position of the transducer with respect to the guide and the light source is such that the light beam can impinge upon the transducer only after having passed, at least once, from the one to the other side of the guide.

If the path is substantially horizontal, the light source can be mounted below the underside and the transducer is then mounted above the upper side of the guide. The guide thereby shields the light source from dust which tends to accumulate at the upper side thereof; furthermore, such dust is swept away by successive increments of the rod which is supported by and travels along the upper side of the guide. The transducer can be mounted below the guide if the light source is mounted above the path for the rod. In each instance, the light beam passes through the guide once before it reaches the transducer provided, of course, that the path for successive increments of the rod is empty. Such monitoring means is preferably designed to transmit a signal in the absence of the rod or discrete sections of the rod.

In accordance with a second embodiment of the invention, both components of the monitoring means are installed below and are thus shielded by the guide. The light beam issuing from the source then passes upwardly through the guide, is reflected by the rod or rod sections and passes downwardly through the guide before it can reach the transducer.

The novel features which are considered as characteristic of the invention are set forth in particular in the appended claims. The improved monitoring apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
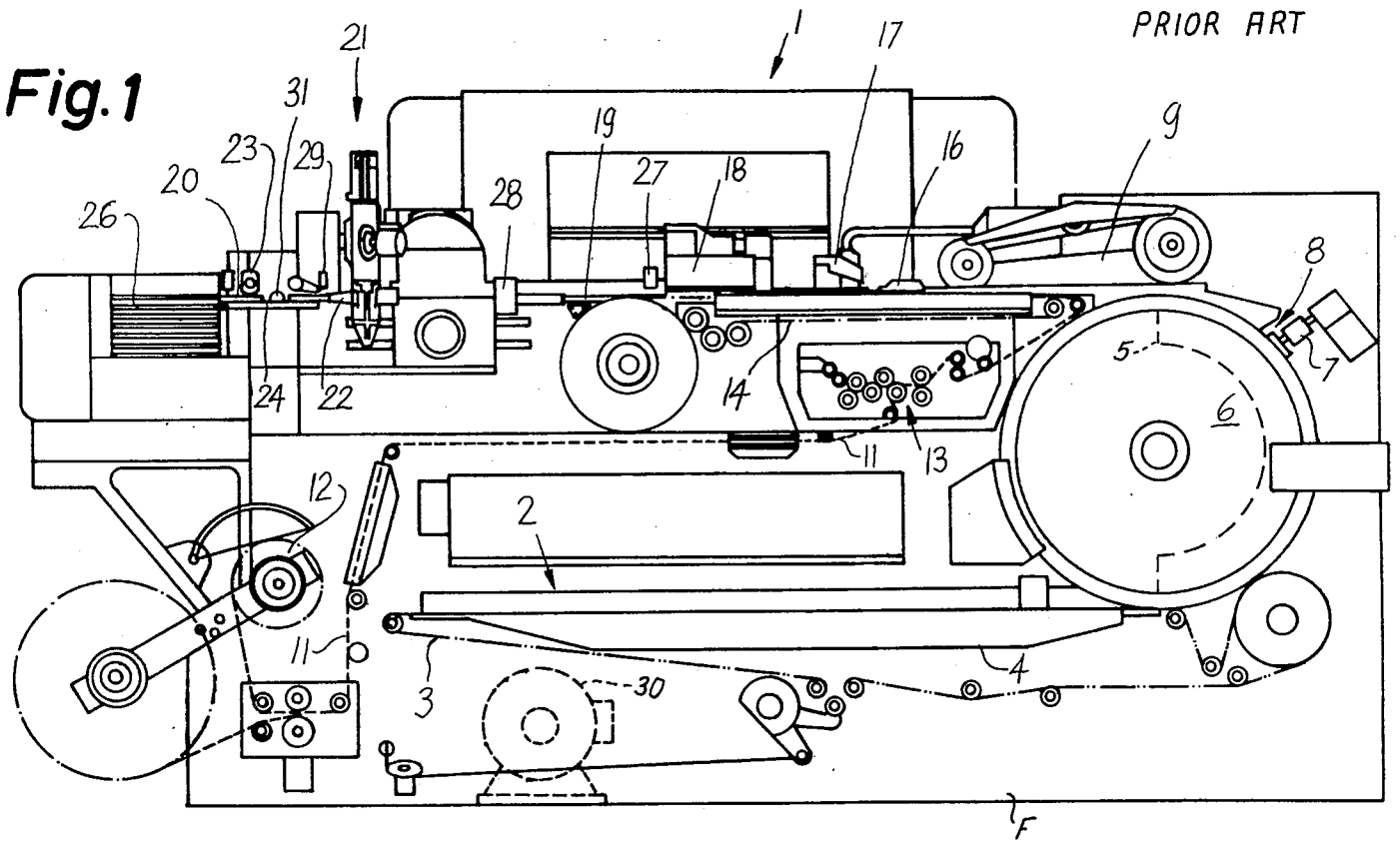
FIG. 1 is a diagrammatic elevational view of a cigarette rod making machine embodying conventional monitoring apparatus.

FIG. 1 shows a cigarette making machine of the type known as GARANT (trademark) produced by Hauni-Werke, Hamburg, Federal Republic Germany. The machine comprises a housing or frame F which supports a distributor 1 serving to shower tobacco shreds into an elongated channel 2 wherein the shreds descend onto the upper reach of a narrow foraminous belt conveyor 3. This upper reach travels above the perforated top wall of a suction chamber 4 which carries the channel 2 and serves to attract the shreds to the conveyor 3 so that the shreds form a growing tobacco stream. The fully grown tobacco stream enters the circumferential groove of a suction wheel 6 a portion of which surrounds a stationary suction chamber 5. The bottom wall of the circumferential groove is foraminous so that the stream is attracted thereto by the suction chamber 5 during travel toward, past and beyond a trimming device 7 which removes the surplus to thus convert the stream into a rod-like filler 8. A foraminous conveyor band 9 has a lower reach which travels below a suction chamber and serves to transfer the filler 8 onto a web 11 of cigarette paper which is advanced by the upper reach of an endless belt conveyor 14 known as garniture.

The web 11 is paid out by an expiring roll 12 and passes through an imprinting mechanism 13 which applies indicia representing the trademark or name of the manufacturer, the brand name of the cigarettes and/or other information.

The garniture 14 transports the web 11 and the filler 8 through a wrapping mechanism 16 which drapes the web around the filler so that one marginal portion of the web extends tangentially of the filler and is coated with adhesive by a paster 17 before the thus coated marginal portion is folded over the other marginal portion of the web to form therewith a seam which extends longitudinally of the resulting cigarette rod 19. The seam is thereupon heated or cooled by a sealer 18 (depending upon whether the paster 17 contains a wet adhesive or a hotmelt) and the rod 19 is severed by a cutoff 21 to yield a single file of discrete plain cigarettes 20 of unit length. During severing, the leader of the rod 19 is supported by a guide 22. Successive discrete cigarettes 20 are accelerated by a rotary cam 23 and are propelled into successive flutes of a rotary drum-shaped row forming transfer conveyor 26 which converts the single file into one or more rows wherein the cigarettes move sideways to the next processing station, e.g., to the assembly conveyor of a filter cigarette making machine. During acceleration by the cam 23, the cigarettes 20 are supported by and travel in a prismatic channel 24.

A photoelectric apparatus 27 monitors the rod 19 downstream of the sealer 18 where the rod is normally not supported by a guide. One function of the apparatus 27 is to activate a device 28 for measuring the density of the filler of the rod 19 as soon as the leader of the rod advances beyond the sealer 18, i.e., subsequent to starting of the machine. Another function of the apparatus 27 is to arrest the prime mover 30 of the machine when the path between the sealer 18 and the density measuring device 28 does not contain a cigarette rod.

A second photoelectric monitoring apparatus or detector 29 is mounted downstream of the cutoff 21 and serves to deactivate a cleaning nozzle 31 for the channel 24 with a predetermined delay following starting of the machine and to start, again with a predetermined delay, the next following machine (e.g., the aforementioned filter cigarette making machine) of the production line which includes the machine of FIG. 1. The detector 29 furnishes a signal when it detects the foremost cigarette 20 of the file of cigarettes advancing beyond the cutoff 21.

The detector 29 of FIG. 1 is a conventionally mounted reflective photoelectric monitoring apparatus. This detector is mounted immediately above or laterally of the path for the cigarettes 20 between the cutoff 21 and the accelerating cam 23. Therefore, the components of the detector 29 are not shielded from dust and/or other foreign matter. As a rule, substantial amounts of tobacco dust will develop in the region of the cutoff 21 so that the light source and/or the photosensitive transducer of the detector 29 is likely to be contaminated after a relatively short period of use. This can give rise to undesirable malfunctions, such as premature or belated deactivation of the nozzle 31 and/or premature or belated starting of the next following machine.

Figure 2:
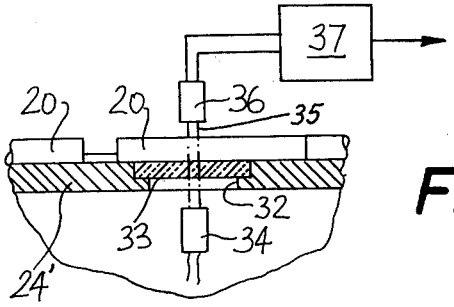
FIG. 2 is an enlarged partly sectional view of a portion of a modified machine including a monitoring apparatus which is installed and shielded in accordance with a first embodiment of the invention.

FIG. 2 shows a photoelectric detector and a modified channel 24', both constructed and installed in accordance with a first embodiment of the invention. The detector (which includes a first component 34 constituting a light source and a second component 36 constituting a photosensitive transducer) is mounted in such a way that at least one of its components is less likely or totally unlikely to be contaminated by dust or other foreign matter. The prismatic channel 24' has a cutout or socket 32 for a plate-like light transmitting insert or guide 33 the upper side of which is nearer to the path of cigarettes 20 than the underside thereof. Actually, the cigarettes 20 sweep along and thereby continuously clean the upper side of the guide 33. The material of the guide 33 may be glass, acrylic glass or another light transmitting (preferably fully transparent) synthetic plastic substance.

The light source 34 of the detector is located below the underside of the guide 33 so that it is adequately shielded from tobacco dust which is intercepted by the guide 33 and swept beyond the detector by successive cigarettes 20. The transducer 36 is mounted above the path for the cigarettes 20 opposite the light source 34 so that the light beam 35 which issues from the source 34 can reach the transducer only after having passed through the lower part of the cutout 32, thereupon through the guide 33 (i.e., from the underside to the upper side of the guide) and across the space between the guide and the transducer.

The transducer 36 forms part of a circuit 37 which initiates a delayed deactivation of the nozzle 31 and a delayed starting of the filter cigarette making machine as soon as an oncoming foremost cigarette 20 interrupts the light beam 35 immediately above the guide 33. The circuit 37 can further serve to arrest the filter cigarette making machine when the light beam 35 again impinges upon the transducer 36 for an interval of time which is long enough to indicate that the making of cigarettes 20 is interrupted, e.g., owing to breakage of the rod 19.

The positions of the components 34, 36 can be reversed, i.e., the transducer 36 will be placed below and shielded by the guide 33 if the light source 34 is placed above the path for cigarettes 20.

The embodiment of FIG. 2 exhibits the advantage that one (34) of the two components of the photoelectric detector is practically completely shielded from dust. The accumulation of dust on the other component (36) which is installed at a level above the path of the cigarettes 20 is minimal and the path of the light beam 35 between the components 34, 36 is also practically free of dust due to the automatic self-cleaning effect which is achieved when the cigarettes slide along the upper side of the guide 33.

The guide 33 is preferably ground and polished together with the channel 24' so that its upper side is flush with and as smooth as the upper side of the channel. The guide can be fixed in place by an adhesive or in any other suitable way.

The light beam 35 may but need not be exactly vertical, as long as at least one of the components 34, 36 is adequately shielded from tobacco dust and/or other foreign matter. The exact construction of these components forms no part of the invention.

Figure 3:
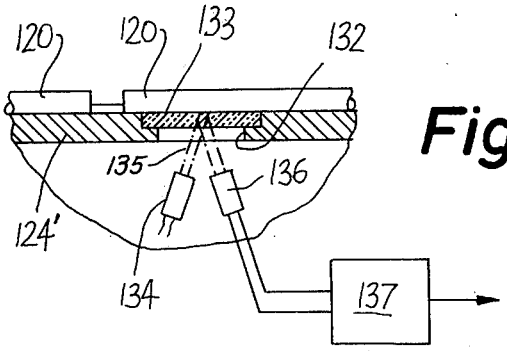
FIG. 3 is a similar view of a portion of a further machine including a monitoring apparatus which is installed and shielded in accordance with a second embodiment of the invention.

FIG. 3 shows a second embodiment wherein all such parts which are identical with or analogous to the corresponding parts of the embodiment of FIG. 2 are denoted by similar reference characters plus 100. In this embodiment, both components (134, 136) of the photoelectric detector are shielded from tobacco dust and other foreign matter to the same extent as the light source 34 of FIG. 2. The light beam 135 issuing from the light source 134 must pass twice through the light transmitting insert or guide 133 before it can impinge upon the photosensitive transducer 136 which forms part of a circuit 137 corresponding to the circuit 37. The light source 134 and the transducer 136 are mounted at a level below the guide 133 so that the latter shields each of these components from tobacco dust. The upper side of the guide 133 is cleaned by cigarettes 120 and the underside of the guide is highly unlikely to accumulate any foreign matter.

It is clear that the position of the transducer 136 with respect to the light source 134 and guide 133 is selected with a view to take into consideration double refraction of the light beam 135, first during penetration into and thereupon during emergence from the material of the guide. In contrast to the detector of FIG. 2, the transducer 136 transmits a signal when its photosensitive surface is illuminated by the light beam 135. In other words, the detector of FIG. 2 detects the absence of a cigarette 20 when the light beam 35 reaches the transducer 36, whereas the detector of FIG. 3 detects the absence of a cigarette 120 when the light beam 135 is not reflected by a cigarette so that it cannot reach the transducer 136.

As a rule, the rod 19 of FIG. 1 is not supported during travel from the sealer 18 toward the cutoff 21. However, if a guide is needed in this region of the cigarette making machine, the guide can consist (at least in part) of light transmitting material and the components of the monitoring apparatus 27 are then installed in a manner as shown in FIGS. 2 or 3.

It is further clear that the invention can be embodied with equal advantage in other types of machines for the processing of tobacco and/or filter material, such as cigar makers, cigarillo makers, filter rod makers, filter cigarette makers and/or others.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a machine for the making of cigarettes or the like wherein successive increments of a rod having a tubular wrapper and fibrous material confined in said wrapper are conveyed lengthwise along an elongated path, the improvement which consists in the provision of a stationary guide consisting of light transmitting material and defining a first portion of said path, said guide having first and second sides located opposite each other and respectively disposed in physical contact with and at a greater distance from the increments in said first portion; means for severing said rod in a second portion of said path upstream of said first portion so that said rod yields a file of discrete sections which move lengthwise toward and through said first portion and each of which corresponds to one of said increments whereby successive sections of said file slide along and are in physical contact with said first side of said guide to sweep away any dust or other foreign matter tending to accumulate on said first side; and photoelectric monitoring means including a first component constituting a light source arranged to direct a light beam against one side of said guide and a second component constituting a photosensitive transducer, the position of said transducer with respect to said guide and said light source being such that said light beam impinges upon said transducer only after having passed at least once through said light transmitting material from said one side to the other side of said guide.

2. The improvement as defined in claim 1, further comprising conveyor means disposed downstream of said first portion of said path and having means for receiving and transporting said discrete sections.

3. The improvement as defined in claim 1, wherein said transducer is disposed at the other side of said guide.

4. The improvement as defined in claim 1, wherein said guide is transparent.

5. The improvement as defined in claim 1, further comprising an elongated channel having a cutout, said guide being located in said cutout.

6. The improvement as defined in claim 1, wherein said guide is a plate.

7. The improvement as defined in claim 1, wherein said guide is free of holes.

8. The improvement as defined in claim 1, wherein said first side of said guide is smooth.

9. The improvement as defined in claim 1, wherein said first side of said guide is free of interruptions.

10. The improvement as defined in claim 1, further comprising a channel for said file of discrete sections, said channel having a bottom portion which includes said guide.

* * * * *